US006942191B2

(12) United States Patent
Zagorsky

(10) Patent No.: US 6,942,191 B2
(45) Date of Patent: Sep. 13, 2005

(54) ANTIROTATION DEVICE

(76) Inventor: Eran Zagorsky, 19163 Ludlow St., Northridge, CA (US) 91326

( * ) Notice: Subject to any disclaimer, the term of this patent is extended or adjusted under 35 U.S.C. 154(b) by 0 days.

(21) Appl. No.: 10/412,467

(22) Filed: Apr. 11, 2003

(65) Prior Publication Data

US 2004/0021043 A1 Feb. 5, 2004

Related U.S. Application Data

(63) Continuation-in-part of application No. 10/060,804, filed on Feb. 1, 2002, now abandoned.

(51) Int. Cl.[7] ..... A47K 1/08
(52) U.S. Cl. ..... 248/313; 248/146
(58) Field of Search ..... 248/146, 152, 248/154, 313, 346.03, 346.01, 213.2, 500; 366/129, 130; 220/737

(56) References Cited

U.S. PATENT DOCUMENTS

| | | | | | |
|---|---|---|---|---|---|
| 509,222 | A | * | 11/1893 | Higbie | 248/158 |
| 2,545,320 | A | * | 3/1951 | Tilson et al. | 248/346.03 |
| 2,683,553 | A | * | 7/1954 | Ariss | 220/700 |
| 3,201,075 | A | * | 8/1965 | Sievers | 248/147 |
| 3,224,595 | A | * | 12/1965 | Sherley | 211/83 |
| 3,414,311 | A | * | 12/1968 | Trimboli | 294/34 |
| 4,084,701 | A | * | 4/1978 | White | 211/81 |
| 4,398,690 | A | * | 8/1983 | Rutledge | 248/150 |
| 4,877,208 | A | * | 10/1989 | Kennard, Jr. | 248/146 |
| 5,217,193 | A | * | 6/1993 | Drucker | 248/148 |
| 5,333,823 | A | * | 8/1994 | Joseph | 248/146 |
| 6,431,391 | B1 | * | 8/2002 | Kaupp | 220/737 |
| 6,651,836 | B1 | * | 11/2003 | Hofheins et al. | 220/575 |

* cited by examiner

*Primary Examiner*—Korie Chan
(74) *Attorney, Agent, or Firm*—Elliott N. Kramsky

(57) ABSTRACT

An antirotation device for preventing undesired rotation of a barrel in which a viscous fluid is being mixed or stirred. The device includes a subsstantially-planar member of generally-rectangular shape. An internal aperture is provided for accommodating a barrel. A clip is provided at the end of a chain that is engaged to a minor side of the substantially-planar member for grasping the brim of the barrel and elevating that side while anti-skid tape is fixed to the substantially-planar member adjacent the other minor side to provide a region onto which the worker may step firmly and securely and thereby effectively apply force for counteracting the torque applied to the barrel by the stirred or mixed viscous fluid. In an alternative embodiment, a rigid elongated strip that includes a hooked end is flexibly engaged to the substantially-planar member by means of a ring in the place of the chain and clip of the other embodiment.

18 Claims, 2 Drawing Sheets

ANTIROTATION DEVICE

REFERENCE TO RELATED APPLICATION

The present application is a continuation-in-part of U.S. patent application Ser. No. 10/060,804 of Eran Zagorsky entitled "Antirotation Device" filed Feb. 1, 2002 now abandoned in the United States Patent and Trademark Office.

BACKGROUND

1. Field of the Invention

The present invention relates to the preparation and use of viscous building materials. More particularly, this invention pertains to a device for preventing undesired rotation of a bucket as viscous material within is stirred.

2. Description of the Prior Art

Many construction and repair tasks require the on-site preparation of a viscous building material. Such materials may include, for example, grout for tile, heavy paints, cement, drywall texture, fireproofing, roof coating and acoustic material such as gypsum.

Often such material is mixed or stirred in a bucket suitable for subsequent transport of the material to the work area. Buckets for such use are commonly of five gallon volume capacity.

Efficient and thorough admixture of material is often facilitated by such automated means as an electric drill having a relatively-long drill bit. Unfortunately, experience has shown that viscous materials are generally transported in a vortex that emanates from the rotating drill bit or other stirrer. The presence of dynamic friction between the material and the inner wall of the bucket results in the imposition of a torsion force causing the bucket to spin. This can be quite annoying to the user and, in fact, can lead to significant spillage and spraying.

SUMMARY OF THE INVENTION

The present invention addresses the foregoing disadvantages of the prior art by providing, in a first aspect, apparatus for preventing rotation of a receptacle. Such apparatus includes a substantially-planar member. Such member has an internal aperture for receiving the receptacle. One end of a chain is engaged to the substantially-planar member. A clip is engaged to the other end of the chain.

In a second aspect, the invention provides apparatus for preventing rotation of a receptacle substantially as above. It differs from the invention in its first aspect insofar as it includes alternative apparatus for engaging the substantially-planar member. Such apparatus includes a rigid elongated strip. One end of such strip comprises a hook and the opposed end has an aperture for receiving a ring. The substantially-planar member has an aperture for receiving the ring whereby the elongated strip and the substantially-planar member are mutually flexibly engaged to one another.

The preceding and other features and advantages of the present invention will become further apparent from the detailed description that follows. Such description is accompanied by a set of drawing figures. Numerals of the drawing figures, corresponding to those of the written description, point to the features of the invention with like numerals referring to like features throughout both the written description and the drawing figures.

BRIEF DESCRIPTION OF THE DRAWING FIGURES

DETAILED DESCRIPTION OF THE PREFERRED EMBODIMENT

Figure 1:
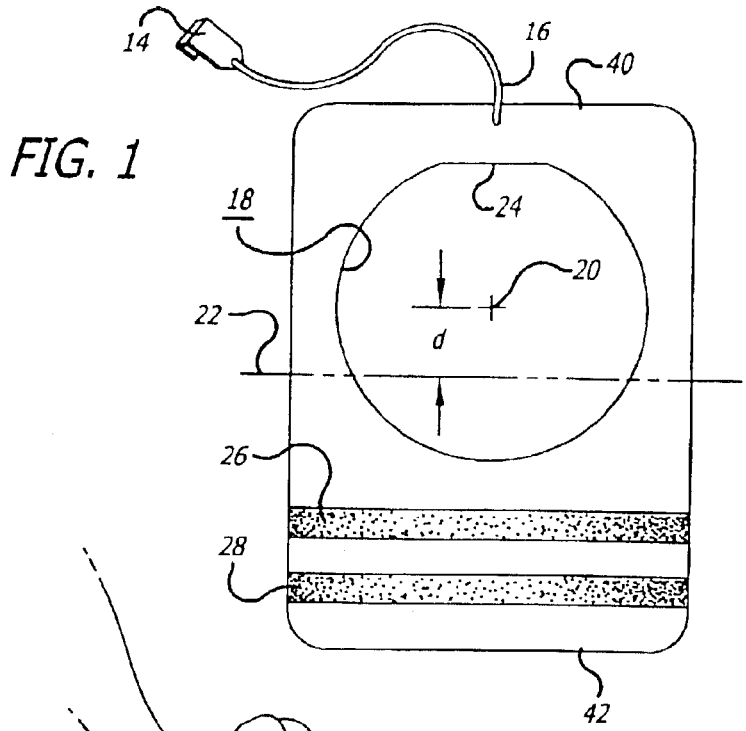
FIG. 1 is a top planar view of the antirotation device of the invention.

Turning now to the drawings, FIG. 1 is a top planar view of the antirotation device 10 of the invention. The antirotation device 10 includes a substantially-planar member 12, preferably of aluminum or other metal or hard plastic, that is joined to a clip 14 (shown in perspective view) by means of a chain 16.

The substantially-planar member 12 has an internal aperture 18 for accommodating a standard receptacle of the type that is commonly employed for holding a viscous material as it is mixed or stirred for use. As mentioned above, such viscous material may be encountered in the processes of grouting, painting, drywall, fireproofing, roofing, soundproofing and the like while the material is commonly handled in a five gallon bucket.

The substantially-planar member 12 should have sufficient strength, stiffness and resilience to withstand permanent deformation when subject to bending in response to anticipated force loads. Such force loads, applied by a worker pressing his boot against the member 12 will be seen, as illustrated in the following figure, to prevent the spinning of a container subjected to a significant degree of torque. An example of an appropriate material for the planar member 12 is ⅛ inch thick aluminum sheeting.

The substantially-planar member 12 has an internal aperture 18. Such aperture 18 may be generally circular with its center 20 offset a distance "d" from the bisector 22 of the major length of the generally-rectangular member 12. The aperture 18 is provided for receiving a bucket when the device is in use. While it is generally-circular, the aperture 18 includes a straight segment 24 at its upper edge. The straight segment 24 will be seen to enhance the ability of the device 10 to grip, and thereby retain and stabilize, the sidewall of a bucket against rotation.

While the center 20 of the aperture 18 is offset above the bisector 22 of the major length of the planar member 12, strips 26, 28 of anti-skid tape are fixed to the region of the member 12 below the bisector 22. Such strips 26, 28 permit the user to transfer force efficiently to the member 12 to, in turn, prevent undesired rotation of a bucket.

Figure 2:
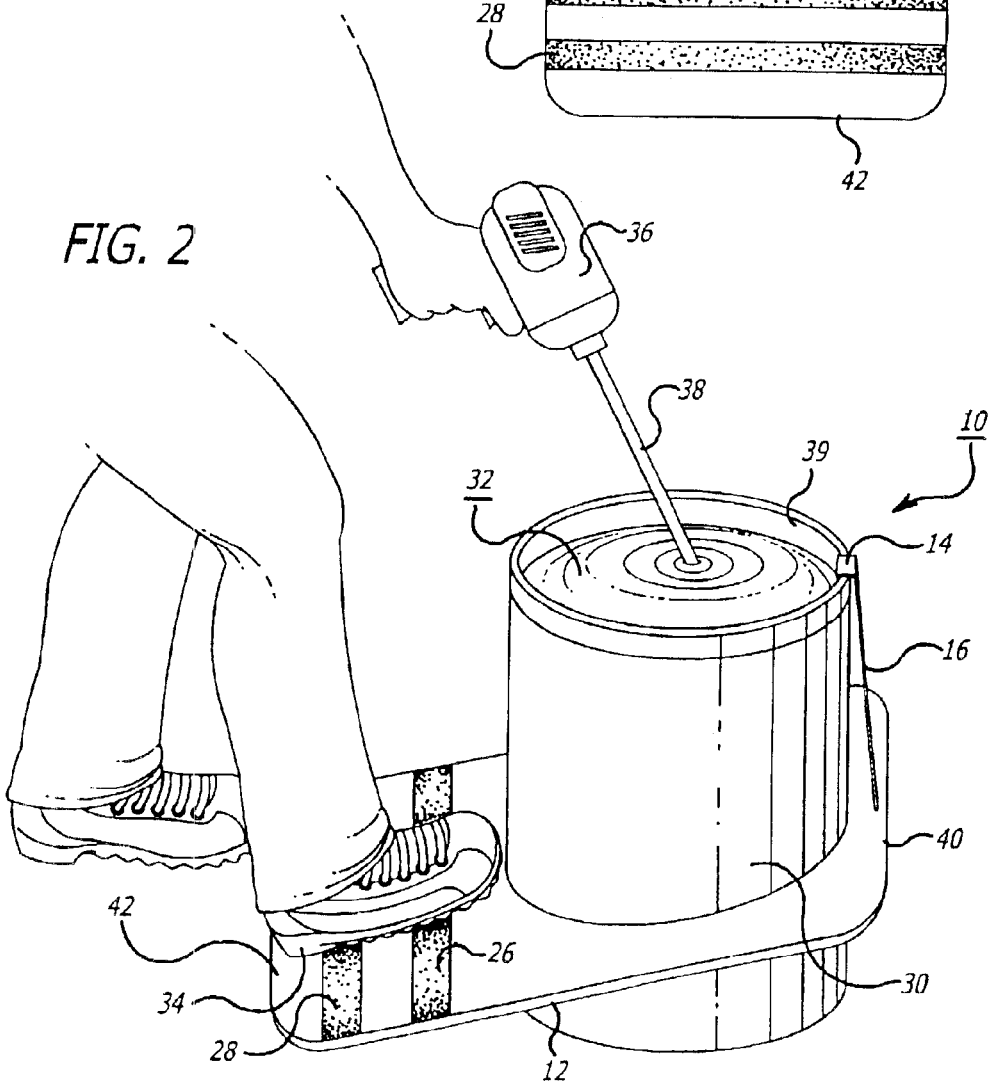
FIG. 2 is a perspective view of the invention in use.

FIG. 2 is a perspective view of the antirotation device 10 in use. The device 10 is employed in FIG. 2 to prevent rotation of a bucket 30 that holds a viscous material 32 as it is mixed. A workman presses with a foot 34 upon the planar member 12 while holding a power drill 36 having a relatively-long bit 38 engaged thereto.

The clip 14 engages the edge of the bucket 30 so that, in combination with the chain 16, it holds the planar member 12 so that the upper edge 40 is elevated above the lower edge 42. The tilted orientation of the planar member 12, in combination with its strength, stiffness and resilience, allows the workman to exert considerable force (at the anti-skid strips 26 and 28) that results in some bending of the planar member 12 so that it attains a slightly upwardly concave shape that reduces the diameter of the aperture 18 to cause the straight edge segment 24 to press into the side of the bucket 30. The translation of the downward force of the foot 34 into such gripping of the side of the bucket 30, combined with the downward force exerted between the lower edge 42 of the member 12 and a floor 44, generates a strong antirotation force that serves to counteract the effect of torsion transferred from the stirred viscous material 32 to the retaining bucket 30.

Figure 3:
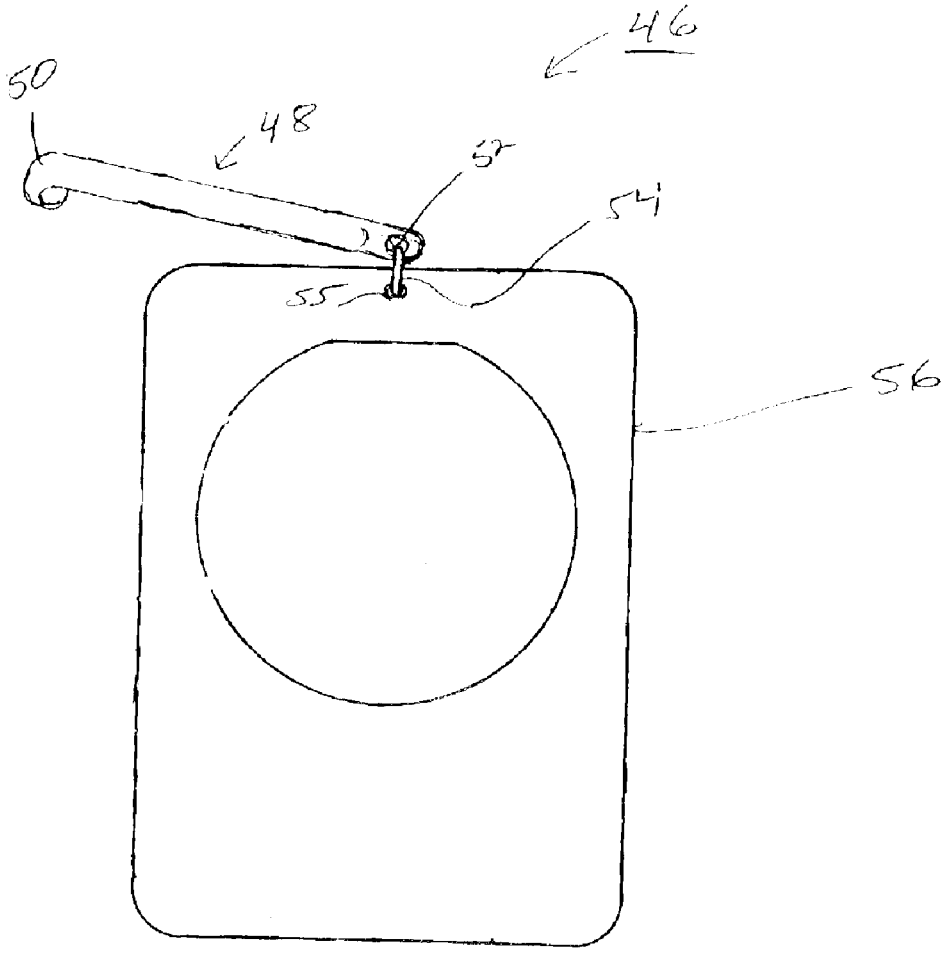
FIG. 3 is a top planar view of an alternative embodiment of the invention.

FIG. 3 is a top planar view of an alternative, and somewhat simpler to manufacture, embodiment of the invention 46. Such embodiment functions in the same manner as that described above. In contrast to the prior embodiment, an elongated strip 48 of rigid material, such as aluminum, is employed in the place of the chain 16. At one end of the elongated strip 48 is a hook 50 that is integral therewith which functions as the clip 14 of the prior embodiment. The opposed end of the elongated strip 48 includes an aperture 52 for receiving a ring 54, also received at an aperture 55 of a planar member 56, that provides the flexible engagement between the elongated strip 48 and the planar member 56 for assuring that the alternative embodiment 46 is fully capable of functioning as illustrated in FIG. 2. As noted, the planar member 56, which is dimensioned and shaped as the substantially-planar member 12, does not include anti-skid strips although such feature may be accommodated within or omitted from each of the illustrated embodiments without departing from the invention.

While the invention has been described with reference to its presently preferred embodiment, it is not limited thereto. Rather, this invention is limited only insofar as it is described by the following set of patent claims and includes within its scope all equivalents thereof.

What is claimed is:

1. An upright receptacle and an apparatus used in resisting the tendency of said upright receptacle, having a top and a bottom separated by a height and containing a viscous material, to rotate on a support surface contacting the bottom of the receptacle in response to application of a stirring force, said apparatus comprising, in combination:

a) a sheet-like, substantially-planar member;

b) said member having an internal aperture surrounding said receptacle;

c) said internal aperture being offset from the center of said substantially-planar member;

d) a chain, one end of said chain being engaged to said substantially-planar member;

e) the opposed free end of said chain being engaged to a clip for securing said free end of said chain to the top of said receptacle; and f) the length of said chain being less than the height of said receptacle whereby said planar member is in contact with and inclined with respect to said surface when secured to said receptacle.

2. Apparatus as defined in claim 1 wherein said sheet-like, substantially planar member is fabricated of resilient material.

3. Apparatus as defined in claim 2 further characterized in that said aperture is generally circular.

4. Apparatus as defined in claim 3 wherein said substantially-planar member is generally-rectangular having opposed minor sides and opposed major sides.

5. Apparatus as defined in claim 4 wherein the center of said aperture lies within a region bounded by one of the minor side and the bisector of the major sides of said substantially-planar member.

6. Apparatus as defined in claim 5 further including:

a) anti-skid tape being fixed to a surface of said substantially-planar member; and b) said anti-skid tape being fixed to said surface within a region bounded by the other minor side and the bisector of the major sides of said substantially-planar member.

7. Apparatus as defined in claim 5 wherein:

a) said aperture includes a straight segment; and b) said straight segment is generally parallel to said minor sides of said substantially-planar member.

8. Apparatus as defined in claim 3 wherein said aperture includes a straight portion.

9. Apparatus as defined in claim 2 wherein said sheet-like, substantially planar member comprises aluminum.

10. An upright receptacle and an apparatus used in resisting the tendency of said upright receptacle, having a top and a bottom separated by a height and containing a viscous material, to rotate on a support surface contacting the bottom of the receptacle in response to application of a stirring force, said apparatus comprising, in combination:

a) a sheet-like, substantially-planar member;

b) said member having an internal aperture surrounding said receptacle;

c) said internal aperture being offset from the center of said substantially-planar member;

d) a rigid elongated strip, one end of said strip comprising a hook for securing said end of said strip to the top of said receptacle and the opposed end of said elongated strip having an aperture which receives a ring;

e) said substantially-planar member having an aperture receiving said ring whereby said elongated strip and said substantially-planar member are mutually flexibly engaged to one another; and f) the length of said strip being less than the height of said receptacle whereby said planar member is in contact with and inclined with respect to said surface when secured to said receptacle.

11. Apparatus as defined in claim 10 wherein said sheet-like, substantially planar member is fabricated of resilient material.

12. Apparatus as defined in claim 11 wherein said sheet-like, substantially planar member comprises aluminum.

13. Apparatus as defined in claim 11 further characterized in that said aperture for surrounding said receptacle is generally circular.

14. Apparatus as defined in claim 13 wherein said substantially planar member is generally-rectangular having opposed minor sides and opposed major sides.

15. Apparatus as defined in claim 14 wherein the center of said aperture for surrounding said receptacle lies within a region bounded by one of the minor side and the bisector of the major sides of said substantially-planar member.

16. Apparatus as defined in claim 15 further including:

a) anti-skid tape being fixed to a surface of said substantially-planar member; and b) said anti-skid tape being fixed to said surface within a region bounded by the other minor side and the bisector of the major sides of said substantially-planar member.

17. Apparatus as defined in claim 15 wherein:

a) said aperture for surrounding said receptacle includes a straight segment; and b) said straight segment is generally parallel to said minor sides of said substantially-planar member.

18. Apparatus as defined in claim 13 wherein said aperture for surrounding said receptacle includes a straight portion.

* * * * *